United States Patent [19]

McCabe

[11] Patent Number: 4,941,396

[45] Date of Patent: Jul. 17, 1990

[54] RECIPROCATING DOUBLE-ENDED PISTON

[76] Inventor: Peter J. McCabe, 12 Riverside Road, Lansvale, New South Wales 2166, Australia

[21] Appl. No.: 276,679

[22] Filed: Nov. 28, 1988

[30] Foreign Application Priority Data

Nov. 27, 1987 [AU] Australia ..... PI5641

[51] Int. Cl.[5] ..... F01B 9/00

[52] U.S. Cl. ..... 92/136; 123/56 C; 123/63; 123/61 R; 74/33; 74/131; 74/132

[58] Field of Search ..... 92/136, 175; 123/56 C, 123/56 R, 61 R, 63; 74/29, 22 R, 89.18, 33, 34, 131, 132

[56] References Cited

U.S. PATENT DOCUMENTS

| | | | |
|---|---|---|---|
| 1,419,693 | 6/1922 | Schultz | 123/63 |
| 1,614,476 | 1/1927 | Hutchinson | 123/63 |
| 1,636,612 | 7/1927 | Noah | 123/63 |
| 2,482,136 | 9/1949 | Wright | 74/131 |
| 4,381,739 | 5/1983 | Fisher | 123/56 C |
| 4,465,042 | 8/1984 | Bristol | 123/56 C |
| 4,485,768 | 12/1984 | Heniges | 123/56 R |
| 4,485,769 | 12/1984 | Carson | 123/61 R |
| 4,492,188 | 1/1985 | Palmer et al. | 123/63 |
| 4,498,430 | 2/1985 | Giuliani et al. | 123/58 R |
| 4,555,903 | 12/1985 | Heaton | 92/136 |

FOREIGN PATENT DOCUMENTS

| | | | |
|---|---|---|---|
| 0140776 | 3/1980 | Fed. Rep. of Germany | 123/63 |
| 3019288 | 11/1981 | Fed. Rep. of Germany | 92/136 |
| 3230508 | 2/1984 | Fed. Rep. of Germany | 92/136 |
| 984871 | 7/1951 | France | 74/131 |
| 607478 | 8/1960 | Italy | 74/131 |
| 0037609 | 3/1977 | Japan | 92/136 |
| 0168001 | 10/1982 | Japan | 92/136 |
| 0072601 | 4/1983 | Japan | 92/136 |

*Primary Examiner*—Robert E. Garrett
*Assistant Examiner*—Thomas Denion
*Attorney, Agent, or Firm*—Hill, Van Santen, Steadman & Simpson

[57] ABSTRACT

The present invention relates to a reciprocating engine which has an improved reciprocating double ended piston which substantially reduces the size and weight of piston components. The double ended piston comprises a center portion between the two end portions. The center portion having at least one pair of racks located along the longitudinal axis either on the outside surface of a pair of flat surfaces or on opposed inside surfaces along a slot cut into the center portion. At least one crankless drive shaft having a gear or pair of gears mateable with the racks so that the crankless drive shaft (s) are continuously rotated.

8 Claims, 9 Drawing Sheets

RECIPROCATING DOUBLE-ENDED PISTON

BACKGROUND OF THE INVENTION

1. Field of the Invention

The present invention relates to reciprocating engines, and in particular, to an improved reciprocating double-ended piston which substantially reduces the size and weight of piston components.

2. Description of the Related Art

Conventional internal combustion engines usually have reciprocating pistons and generally operate on combustion cycles depending on the uses to which the engines are to be put. The cycle can either be a constant volume process which is characteristic of the spark-ignition or Otto cycle or constant pressure process found in the compression-ignition or Diesel cycle. Alternatively, a mixed cycle occurring in high speed compression-ignition engines can also be used. The fundamental differences between the different cycles are the methods of mixing the air and fuel and the methods of ignition.

The normal four-stroke cycle which uses the Otto cycle requires four piston-strokes or two crankshaft revolutions per cycle. Four-cycle engines are generally single-acting (combustion only on one side of the piston) and therefore a multi-cylinder engine utilizes a number of pistons, connecting rods and connecting rod utilizes a number of pistons, connecting rods and connecting rod bearings in the engine. A double ended piston driving a shaft through an inclined disc has been known and used in the Mitchell engine of the 1920's. However, such engines are unsuitable for use in smaller type operations due to their unstable character.

SUMMARY OF THE INVENTION

It is an object of the present invention to provide an improved reciprocating double ended piston which is able to be used in an internal combustion engine which is stable. It is also an object to thereby reduce the size and weight of the piston components and thereby reduce the size and weight of the internal combustion engine.

According to one aspect of the present invention there is disclosed a double-ended piston for use in a reciprocating internal combustion engine, said double-ended piston having at both its ends cylindrical portions with grooves located therearound to thereby be fitted with compression and oil control rings, a center portion having at two opposite sides a pair of racks means offset to each other, wherein in a reciprocating internal combustion engine, at least one crankless drive shaft has a gear mateable with said pari of rack means to thereby continuously rotated by the reciprocating movement of the double-ended piston. Preferably, the double-ended piston is used in a pair of horizontally opposed cylinders in the internal combustion engine.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
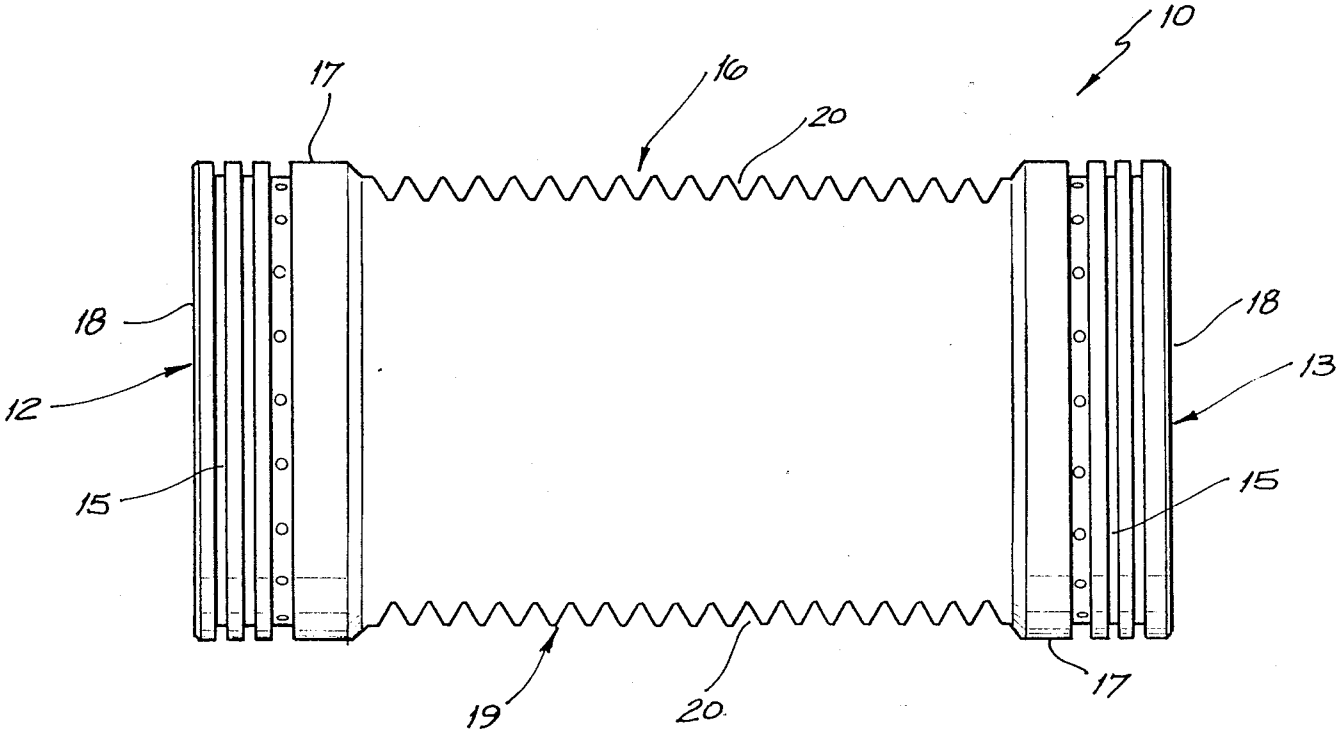
FIG. 1 is a side view of a double-ended piston of a preferred embodiment.
Figure 2:
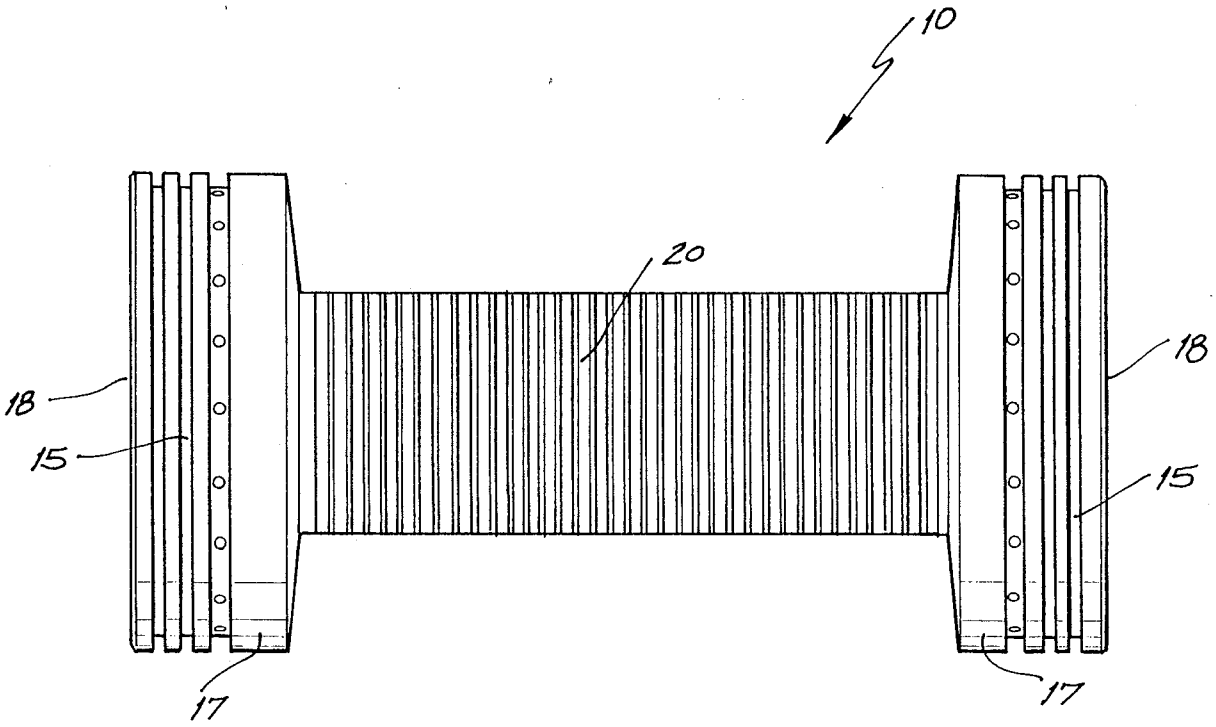
FIG. 2 is a top view of the double-ended piston of FIG. 1.

FIGS. 1–4 show the invention mounted in a cylinder 14 in an engine (not illustrated). Located at both ends 12 and 13 are grooves 15 to accommodate one or more compression and oil rings (not illustrated) as in a conventional piston.

The double-ended piston 10 can be constructed of iron, steel or alloy and can be hollow or solid with a rack 20 fitted on its flat upper and lower surfaces 16 and 19, respectively.

The rack 20 can be cast, machined, riveted, screwed or welded to the respective surfaces 16 and 19. The racks 20 can be helical or spur, or a combination spur of small and larger teeth to minimize noise.

To reduce weight and friction, the piston 10 has just sufficient skirt 17 at both ends 12 and 13 to accommodate the one or more compression and oil rings. Where the piston 10 has to cover/uncover ports as in a two-stroke engine, the piston skirts 17 can be longer. The skirts 17 can be entirely cylindrical or they can be tapered at the ends of the racks 20.

The piston heads 18 can be of a regular or irregular shape (flat, domed, notched, wedged) and may be constructed so as to have the combustion chamber in the heads 18, for example, a "Heron" bowl-in-piston chamber. It is also possible that the heads 18 contain a ceramic insert as a means of reducing piston-head temperature. Additionally, the ceramic insert can form the combustion chamber shape.

The piston 10 can also be constructed as to contain a central slot into which could pass the piping, wiring, oil, shaft etc. The "column" shape of the piston 10 effects a saving in weight, yet allows oil to be directed over substantially the entire piston surface, excluding the piston head 18.

Figure 3:
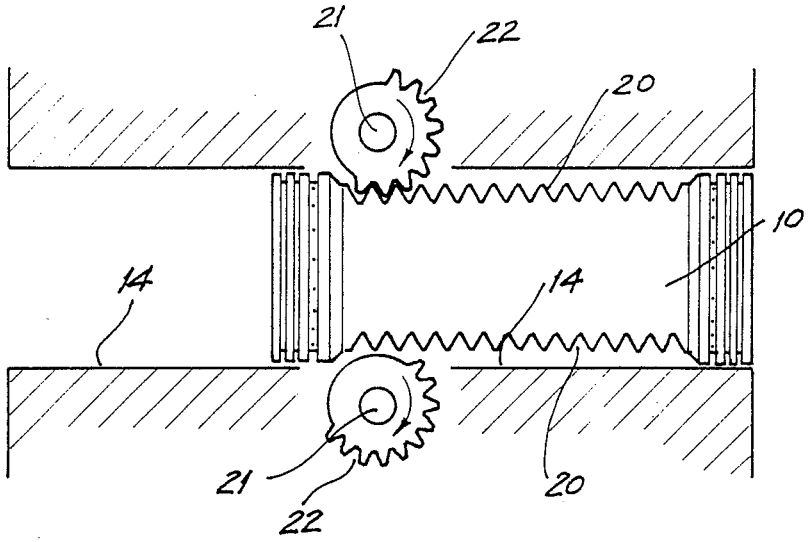
FIG. 3 is a schematic side view of the double-ended piston of FIG. 1 illustrated with a pair of engaged shafts, in a cylinder arrangement.

Illustrated in FIG. 3 is a piston 10 within a pair of cylinders 14. A pair of crankless shafts 21 each having an escapement-type gear 22 located thereon are arranged so that the gears 22 engage the racks 20 of the piston 10 in such a way that as the piston 10 moves in one direction the gears 22 are moved by the racks 20 in a single direction. Viewed from the front, both shafts 21 rotate always in the clockwise direction with the upper rack 20 engaging the upper shaft's escapement-type gear 22 on the initial stroke and the lower rack 20 engages the lower shaft's escapement-type gear 22 on the return stroke. Only one of the gears 22 at a time is engaged by the piston 10 as it travels in both directions, which can be seen from the drawings as the gears 22 only cover half the circumference of the disk 23.

Figure 4:
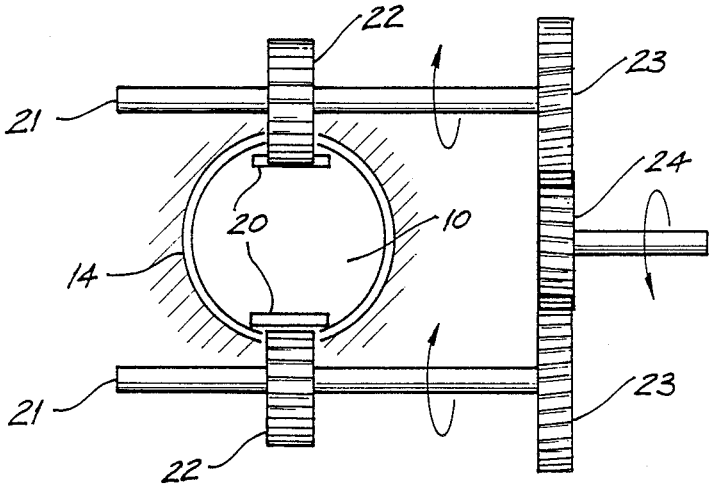
FIG. 4 is a schematic view of the arrangement of FIG. 3.

As illustrated in FIG. 4, the shafts 21 each carry one of a pair of gears 23 which rotate clockwise with the shafts 21. An idler gear 24 rotates in an anti-clockwise direction and connects the two gears 23, so that the two shafts 21 are interconnected.

Figure 5:
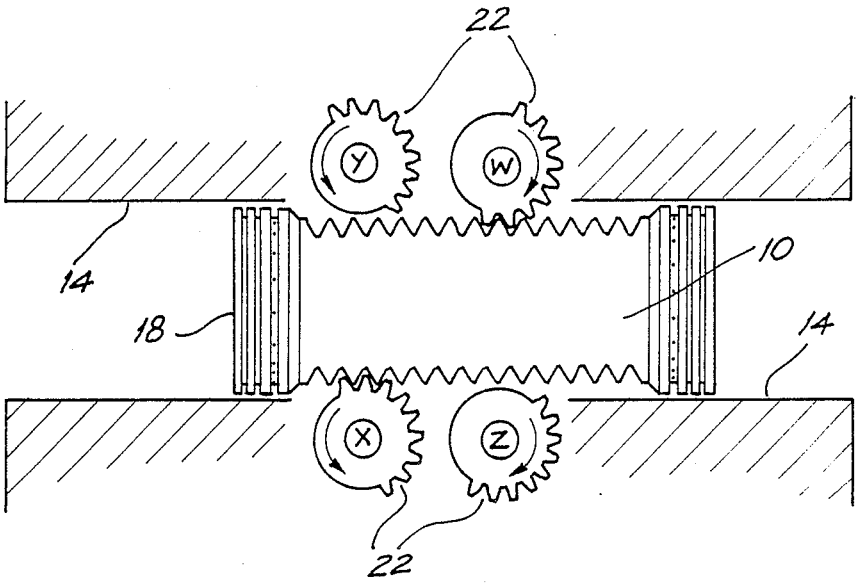
FIG. 5 is a schematic side view of an arrangement of a different embodiment to the arrangement of FIG. 3.
Figure 6:
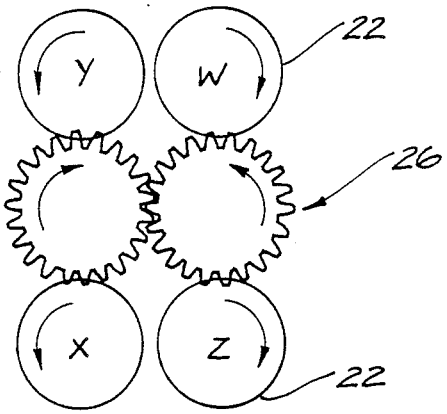
FIG. 6 is a schematic view of the arrangement of FIG. 5 illustrated with a pair of idler gears.

Another embodiment of the invention is illustrated in FIGS. 5 and 6. In this arrangement, four shafts each having gears 22 are utilized, with both the upper and lower racks 20 being engaged continuously. As the piston 10 moves down both the cylinders 14, the shafts 21 which have the half gears W and X are set in motion while the gears Y and Z are engaged on the return stroke. A pair of idler gears 26 which are meshed with gears Y, W, X, and Z complete the gear train as illustrated in FIG. 6.

Another configuration could possibly utilize chains and sprockets, dispensing with the idler gears. However, this is not illustrated.

Figure 7:
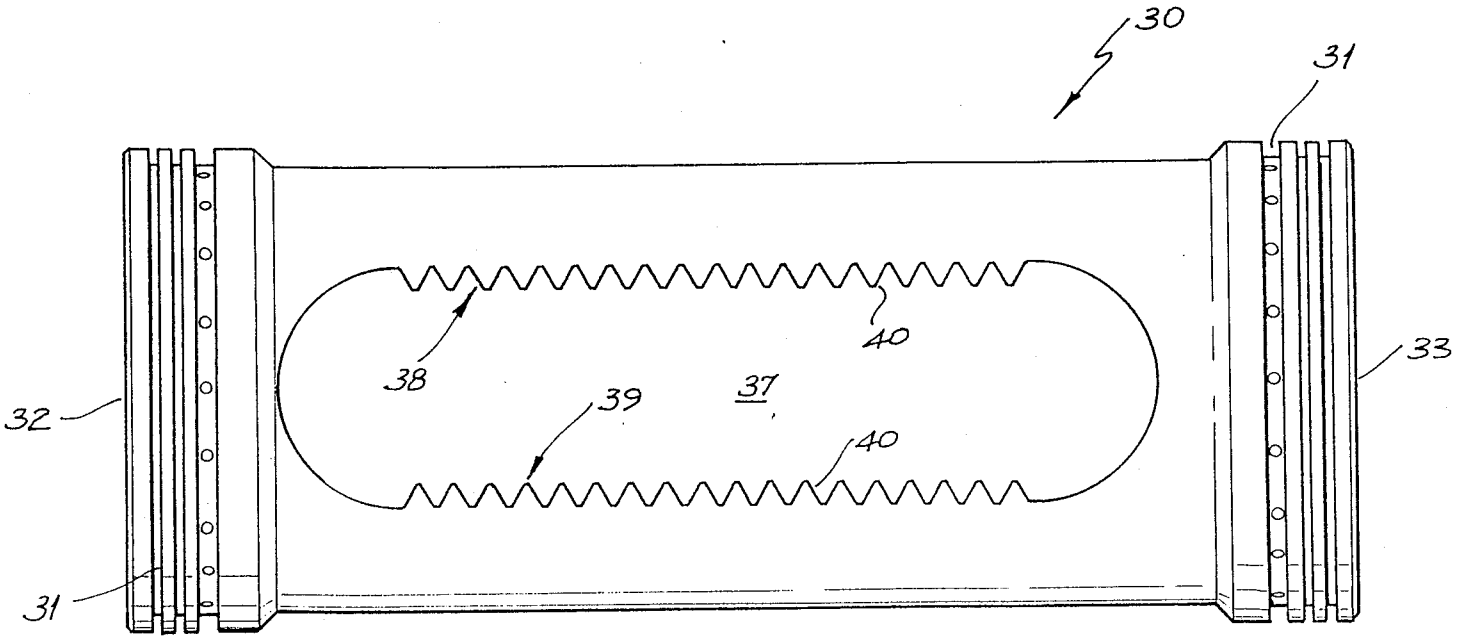
FIG. 7 is a side view of a double-ended piston of another embodiment.
Figure 8:
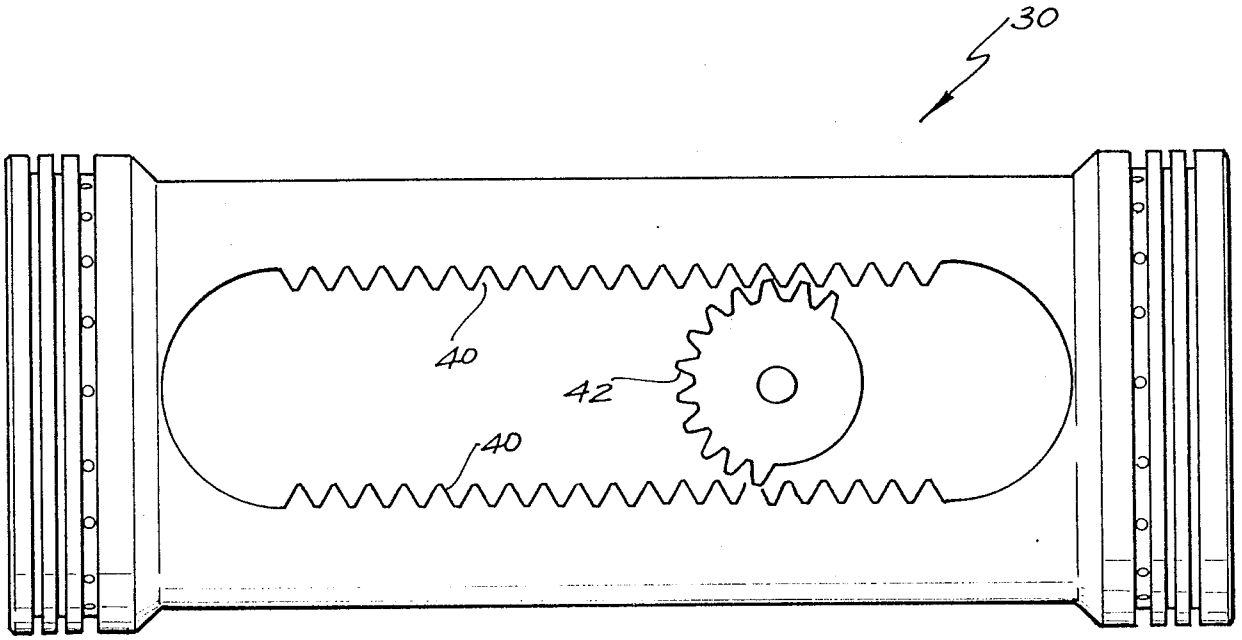
FIG. 8 is a schematic side view of the double-ended piston of FIG. 6 illustrated with a single engaged shaft in a cylinder arrangement.
Figure 9:
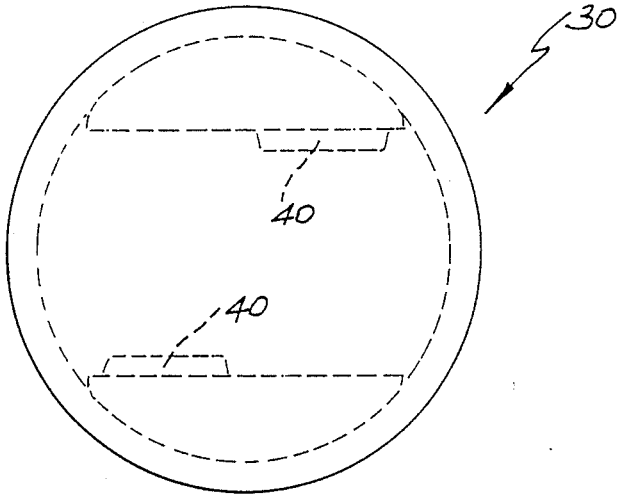
FIG. 9 is a cross-section of the double-ended piston of FIG. 8.
Figure 10:
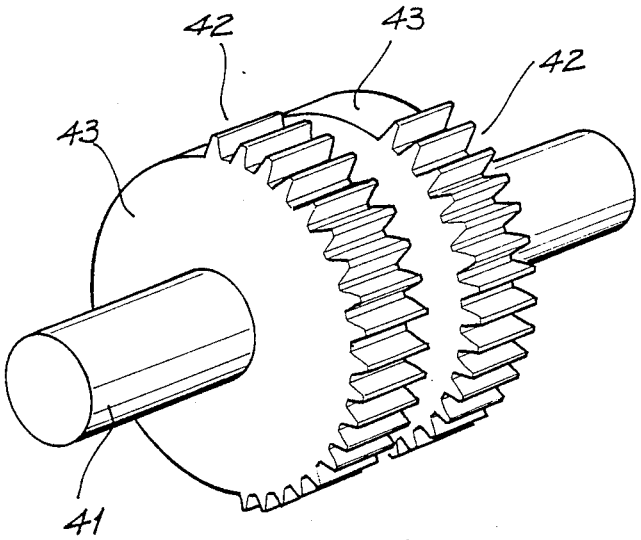
FIG. 10 is a perspective view of a crankless shaft which is drive by the reciprocating pistons.

Another embodiment of the present invention is illustrated in FIGS. 7 to 9. In this embodiment, a double ended piston 30 has ends 31 and 33 which have a cylindrical profile as to fit into a cylinder 34. Located at both ends 32 and 33 are grooves 31 to accommodate compression and control rings as in a conventional piston. Located at the center portion (or connecting rod 36) of the piston 30 is a slot 37. The slot 37 is aligned with the longitudinal axis of the piston 30. Along each of the longer sides 38 and 39 of the slot 37 are two racks 40 which are offset as illustrated in FIG. 9.

Figure 11:
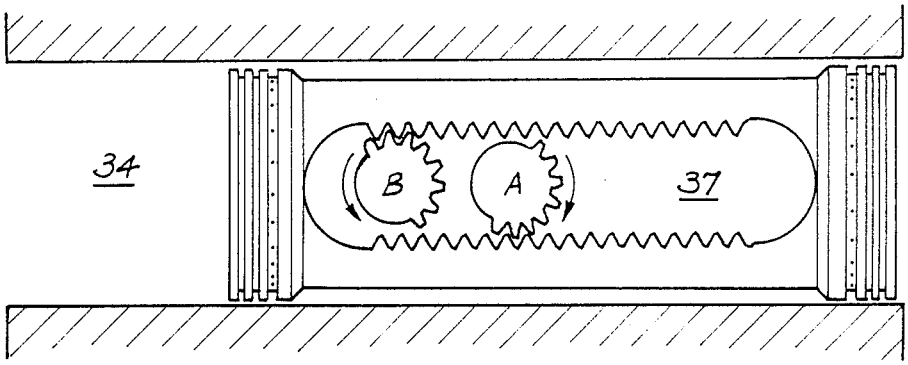
FIG. 11 is a side view of a double-ended piston of another embodiment illustrated with a pair of engaged shafts in a cylinder arrangement.

Illustrated in FIG. 11 is a crankless shaft 41 which has pair of parallel escapement-type gears 42. The gears 42 engage the racks 40 of the piston 30 in such a way that as the piston 30 moves in one direction one of the gears 42 is moved by the rack 40 in the clockwise direction while as the piston 30 goes in the opposite direction the other gear 42 also rotates the shaft 41 in a clockwise direction. Only one of the gears 42 at a time is engaged by the piston 30 as it travels in both directions, which as can be seen in FIG. 11 the gears 42 only cover half the circumference of the parallel disks 43.

Figure 12:
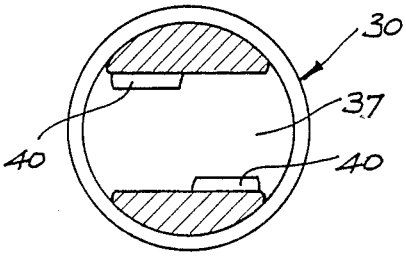
FIG. 12 is a cross-sectional view of the double-ended piston of FIG. 11.
Figure 13:
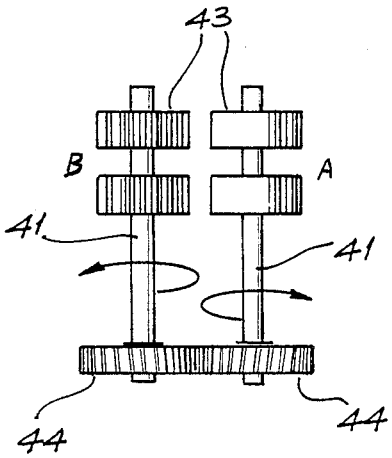
FIG. 13 is a schematic view of the arrangement of FIG. 10.
Figure 14:
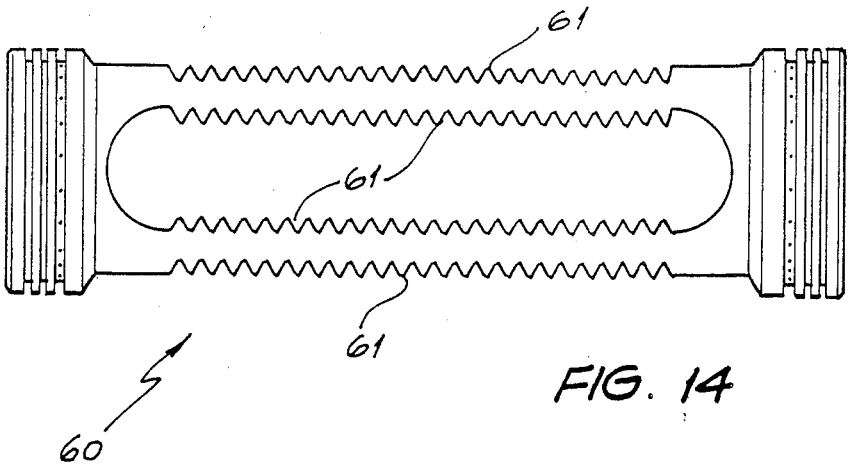
FIG. 14 is a side view of a double-ended piston of another embodiment.

Illustrated in FIGS. 11 to 13 is another embodiment similar to that of the above described embodiment. A pair of shafts 41 each carry two-half gears 42. The racks 40 inside the slot 37 are offset as illustrated in FIG. 14. The piston when moving down the cylinder 34 revolves the main shaft A in a clockwise direction and the auxiliary shaft B in an anti-clockwise direction. On a return stroke the other half gears are engaged by the respective shafts. At the front, helical gears 44 mesh thus transferring the power from the auxiliary to the main shaft A.

Figure 15:
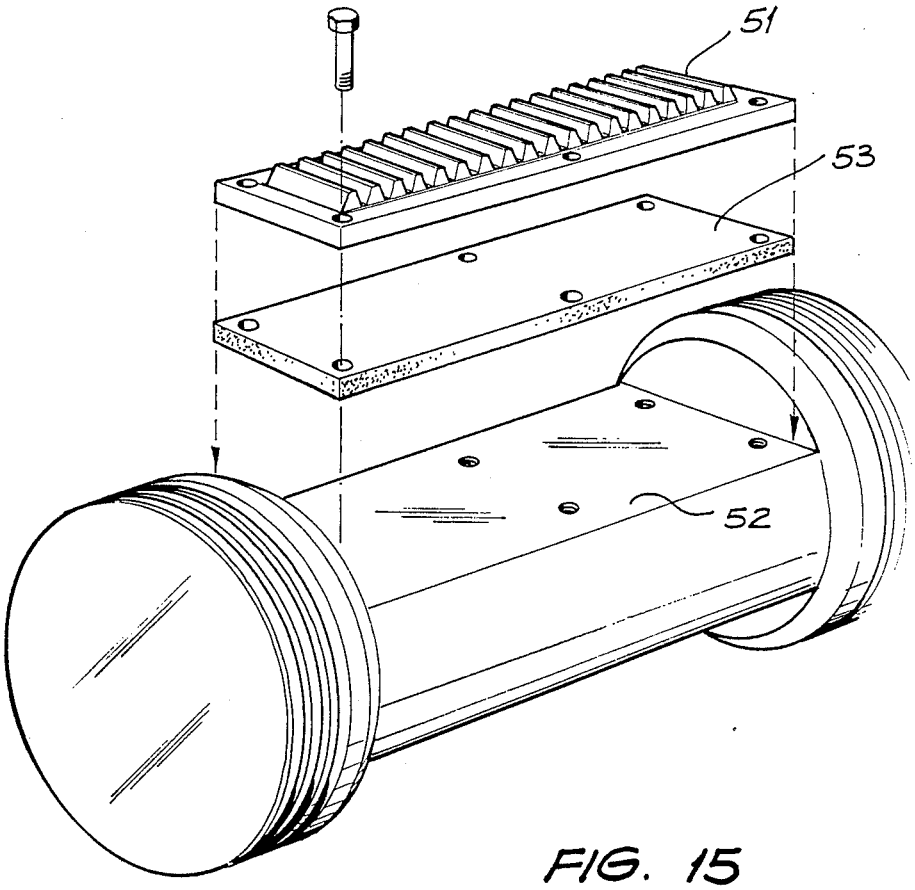
FIG. 15 is a perspective view of another embodiment of the invention.

Another embodiment is illustrated in FIG. 15. In this embodiment, the racks 51 are attached (bolted, screwed, riveted) to the flat piston surface 52. A strip of vibration-absorbing material 53 is interfaced between the racks 51 and the piston surface.

Another embodiment is illustrated in FIG. 14, and this embodiment comprises a piston 60 which has both internal and external racks 61. The illustration is a schematic type diagram to illustrate the basic construction of such a piston 60.

The main advantages of such a piston and crankless shaft arrangement of the preferred embodiment is that the number of pistons, connecting rods and connecting rod bearings that are used in most internal combustion engines is decreased and therefore the size and weight of such an engine is also decreased which in turn increases the efficiency of the engine.

The foregoing describes only some embodiments of the present invention and modifications obvious to those skilled in the art can be made thereto without departing from the scope of the present invention.

I claim as my invention:

1. A double ended piston for use in a reciprocating internal combustion engine, said double-ended piston having heads at both end portions, and a center portion having at least one pair of rack means substantially along the longitudinal axis of said piston, and wherein said pair of rack means are located on a pair of parallel flat surfaces along the length of said central portion, and wherein there are two crankless shafts for each rack, each having a gear sprocket per crankless shaft, wherein the gear's teeth extend around approximately one half the circumference of each gear sprocket and the crankless shafts are intermeshed to provide co-ordinated rotational force.

2. A double ended piston for use in a reciprocating internal combustion engine, said double-ended piston having heads at both end portions, and a center portion having at least one pair of rack means substantially along the longitudinal axis of said piston, wherein at least one crankless drive shaft has at least one gear sprocket mateable with said pair of rack means to thereby be rotated by the reciprocating movement of the double-ended piston, and wherein said pair of rack means is located along longitudinal sides of a slot cut longitudinally into said central portion of said piston where each said rack means are offset from the opposite said rack means, and consist of two sub rack means offset from each other, and there is one crankless shaft having a parallel pair of gear sprockets each of which engage one of the sub rack means, and wherein the gear's teeth extend around approximately one half the circumference of each gear sprocket.

3. A double ended piston according to claim 2 wherein there are two crankless shafts each having a pair of gear sprockets each of which engage one of sub rack means, and where the crankless shafts are intermeshed to provide co-ordinated rotational force.

4. A double ended piston for use in a reciprocating internal combustion engine, said double-ended piston having heads at both ends portions, and a center portion having at least one pair of racks means substantially along the longitudinal axis of said piston, wherein there are at least two crankless drive shafts each having at least one gear sprocket mateable with said pair of rack means to thereby be rotated by the reciprocating movement of the double-ended piston, wherein the teeth of the gears extend around approximately half the circumference of each gear sprocket and the crankless shafts are intermeshed to provide co-ordinated rotational force.

5. A double ended piston according to claim 4 wherein said pair of rack means is located along longitudinal sides of a slot cut longitudinally into central portion of said piston.

6. A double ended piston according to claim 5 wherein each said rack means are offset from the opposite said rack means, and consist of two sub rack means offset from each other.

7. A double ended piston according to claim 6 wherein there is one crankless shaft having a parallel pair of gear sprockets corresponding to and engage one of the sub rack means, wherein the teeth of the gears are approximately half the circumference of each gear sprocket.

8. A double ended piston according to claim 7 wherein there are two crankless shafts each having a pair of gear sprockets to each engage one of sub rack means, where the crankless shafts are intermeshed to provide co-ordinated rotational force.

* * * * *